US005791798A

United States Patent [19]

Yu

[11] Patent Number: 5,791,798

[45] Date of Patent: Aug. 11, 1998

[54] MULTI-PURPOSE WRITING INSTRUMENT

[76] Inventor: Li Hua Yu, No. 17, Alley 23, Lane 2, Sec. 6, Chung Shan No. Rd., Taipei, Taiwan

[21] Appl. No.: 593,170

[22] Filed: Feb. 1, 1996

Related U.S. Application Data

[63] Continuation-in-part of Ser. No. 444,717, May 19, 1995, abandoned.

[51] Int. Cl.[6] ..... B43K 27/00

[52] U.S. Cl. ..... 401/57; 401/18; 401/34; 401/90; 401/97

[58] Field of Search ..... 401/57, 90, 76, 401/97, 18, 34, 85, 87, 96

[56] References Cited

U.S. PATENT DOCUMENTS

| | | | |
|---|---|---|---|
| 468,744 | 2/1892 | Greenwald | 401/96 |
| 940,797 | 11/1909 | Fraser | 401/96 |
| 1,606,909 | 11/1926 | Wahl | 401/87 |
| 1,737,798 | 12/1929 | Kinzinger | 401/57 |
| 1,808,489 | 6/1931 | Bassi . | |
| 1,916,199 | 7/1933 | Back . | |
| 2,354,402 | 7/1944 | Petruccione et al. . | |
| 2,422,705 | 6/1947 | Saint Clair | 401/97 |
| 2,493,892 | 1/1950 | McPhee . | |

FOREIGN PATENT DOCUMENTS

| | | | |
|---|---|---|---|
| 153513 | 10/1953 | Australia | 401/57 |
| 450464 | 8/1948 | Canada | 401/85 |
| 1087353 | 2/1955 | France | 401/97 |
| 356373 | 9/1961 | Switzerland . | |
| 510649 | 8/1939 | United Kingdom . | |
| 589441 | 6/1947 | United Kingdom | 401/97 |
| 613673 | 12/1948 | United Kingdom . | |
| 2 246 979 | 2/1992 | United Kingdom . | |

*Primary Examiner*—Steven A. Bratlie
*Attorney, Agent, or Firm*—Bacon & Thomas

[57] ABSTRACT

A multi-purpose writing instrument having a series of writing tips for various uses includes a hollow tubular mounting having a mounting wall surrounding a through hole, an upper end of the mounting wall forming a mounting step with inner threads. A lower section of the mounting wall has a tapered configuration which extends downwardly to form a straight section having a tip hole. An outer surface of the lower section of the mounting wall is cut horizontally and then vertically to form an insert surface and an insert step which is, in turn, joined to a plurality of outer threads before extending to the tapered end. The outer diameter of the insert surface corresponds to the diameter of the mounting hole while the external and internal holes engage each other. The writing tip has a size matching that of the tip hole so that it may fit firmly into the tip hole.

10 Claims, 5 Drawing Sheets

MULTI-PURPOSE WRITING INSTRUMENT

This application is a continuation-in-part of application Ser. No. 08/444,717, filed May 19, 1995, abandoned.

BACKGROUND OF THE INVENTION (a) Field of the Invention

The present invention relates generally to a writing instrument, and more particularly to a multi-purpose writing instrument.

(b) Description of the Prior Art

Conventional writing instruments are usually designed to have only a single function. For instance, color pencils are single-colored; pencils are single-graded. Pencils and color pencils, in particular, are often discarded after they have been sharpened to an extent too short for holding. Besides, pencil shavings are also a waste of material. As for ball pens and fountain pens, their barrels or casings are often discarded after use, which not only is a waste of material but also pollutes the environment.

There are also available on the market mechanical pencils or refillable lead pencils wherein the lead point may be caused to project from or retract into a barrel by means of pressing a barrel cap. However, the diameter of the lead point is restricted to a single size, e.g., 0.3 mm or 0.5 mm. Therefore, a user may need to buy several mechanical pencils with lead points of various diameters. The same problem exists with color pencils. Although efforts have been made to offer improved writing instruments, such as the block type writing instrument shown in FIG. 1, to improve the problems in the prior art, they remain restricted to single-function ones. In addition, there is another type of pencil in which a series of lead mountings are inserted inside a barrel. However, if the point of a lead mounting has become blunt through use, it has to be removed by hand from an opening at a bottom end of the barrel and inserted into another opening at a top end of the barrel so as to press the lead mounting nearest the bottom opening outwardly so that a fresh point projects suitably therefrom for writing. Such an arrangement is very inconvenient to the user since his/her fingers may easily get dirty when removing the lead mounting.

SUMMARY OF THE INVENTION

Accordingly, a primary object of the present invention is to provide a multi-purpose writing instrument to eliminate the drawbacks in the prior art, wherein a series of tip mountings with tips of various lead grades, colors, etc., may be joined firmly together to form a multi-purpose writing instrument.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
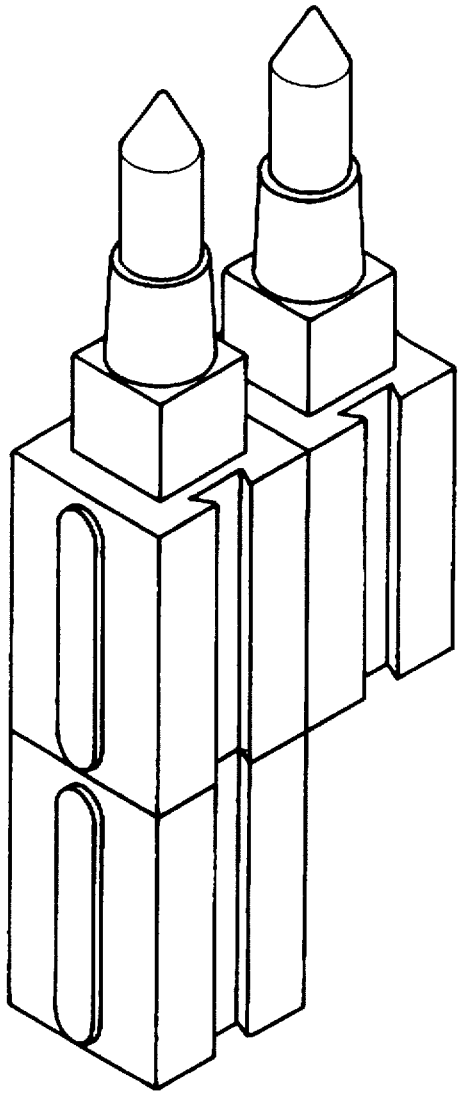
FIG. 1 (PRIOR ART)
FIG. 1 is an elevational view of a block type writing instrument of the prior art.

As shown in the drawings, the present invention essentially comprises a plurality of writing units screwably connected together, and each writing unit consists of a mounting 1 and a writing tip 2.

Figure 2:
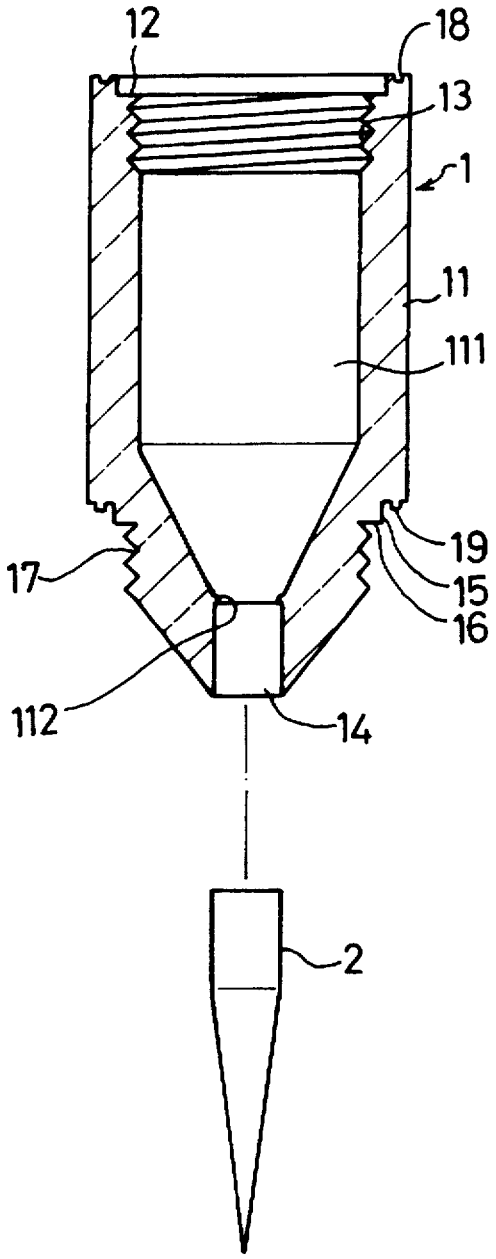
FIG. 2 is partly exploded, schematic view of a preferred embodiment of a writing unit according to the present invention.

With reference to FIG. 2, the mounting 1 is substantially a hollow circular tube structure having a mounting wall 11 surrounding a through hole 111. The inside of the mounting wall 11 at an upper end thereof forms a mounting step 12 with at least an inner thread thread formed below the mounting step 12. In this example, a plurality of inner threads 13 are provided. A lower section of the inside of the mounting wall 11 is configured to taper downwardly before forming a straight section having a tip hole 14. A lower section of the outside of the mounting wall 11 is cut horizontally and then straightly to form an insert surface 15 and a horizontal insert step 16 with at least an outer thread formed therebelow. In this example, a plurality of outer threads 17 are provided. The outside of the mounting wall 11 adjacent the outer threads 17 is cut obliquely to form a tapered end portion. The external diameter of the insert surface 15 is configured to correspond to that of the mounting hole 111, while the outer threads 17 match the inner threads 13 so that a plurality of mountings 1 may be screwably connected.

In order that the vertical connection between mountings 1 may have better stability, as shown in FIG. 2, a top side of the mounting wall 11 is provided with a plurality of notches 18, and a plurality of lugs 19 are integrally formed on a horizontal side of the insert surface 15 for enhancing the connection between mountings 1.

In addition, in order to prevent the writing tip 2 from slipping upwardly upon the application of pressure, a pair of oppositely disposed stops 112 are integrally formed on the inside of the mounting wall 11 at the juncture between the tip hole 14 and the mounting hole 111 to stop the writing tip 2 from being displaced upwardly.

The writing tip 2 is an elongated structure having an upper section matching the tip hole 14 in size so that they may be firmly coupled together. The writing tip 2 may be a lead tip, a color pencil tip, a crayon tip, a ball-point, and the like.

Figure 3:
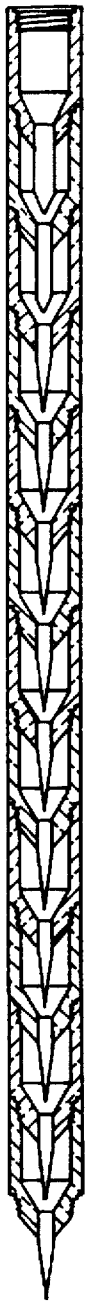
FIG. 3 is a perspective view showing a series of writing units of the present invention joined together.

With reference to FIG. 3, the writing units 1 are properly fitted together in a series. After assembly, each writing unit has its outer threads 17 engaging the inner threads 13 of an adjacent writing unit and has its insert step 16 pressing against the mounting step 12 of the adjacent writing unit.

Figure 4:
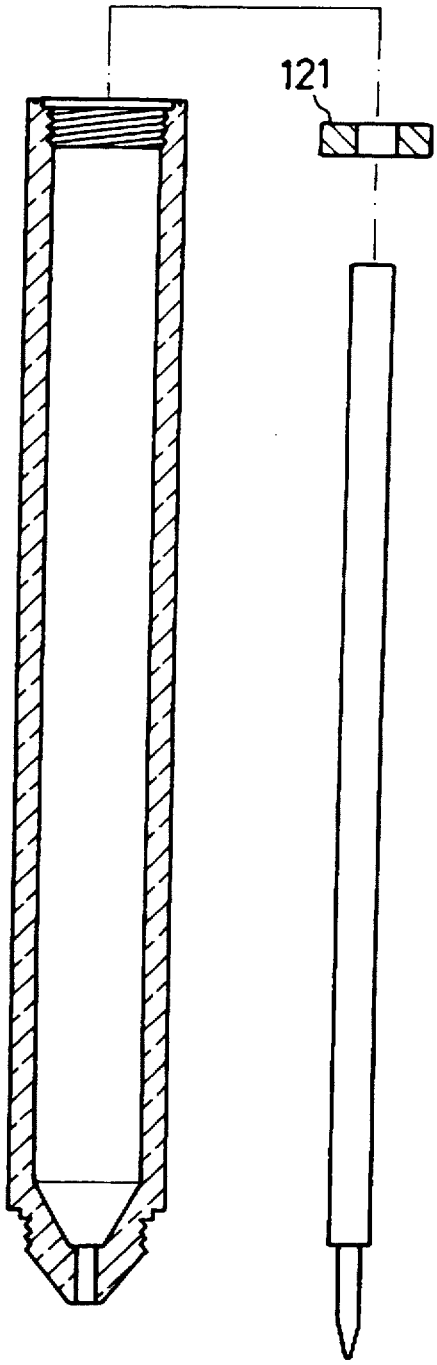
FIG. 4 is a schematic view showing a longer mounting and a longer writing tip according to the present invention.

In another example, as shown in FIG. 4, in order to accommodate longer writing tips 2, the mounting wall 11 may be lengthened and further provided with a plug 121 which matches the mounting step 12 in size so that it may fit into the upper end of the mounting wall 11 to prevent the writing tip 2 from slipping out.

Figure 5A:
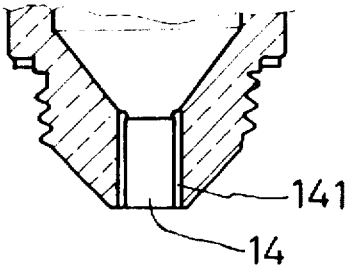
FIG. 5*a* is a longitudinal sectional view of the mounting according to the present invention.
Figure 5B:
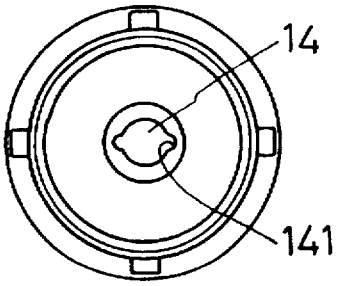
FIG. 5*b* is a cross-sectional view of the mounting, illustrating the tip hole with projections.

Referring to FIG. 5, the tip hole 14 of the mounting 1 may have a part or parts thereof extending outwardly to form a projection(s) 141 to constitute an air vent(s) after the writing tip 2 is fitted into the tip hole 141, so as to prevent children from being suffocated by the writing units if they are accidentally swallowed.

Figure 6:
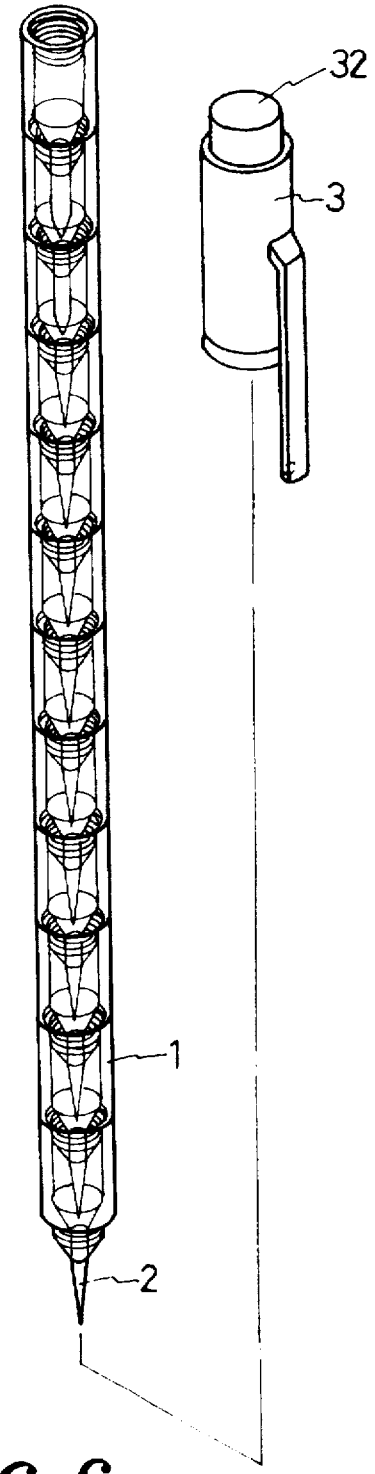
FIG. 6 is a schematic view of the present invention, showing a plurality of mountings with various writing tips connected in a series.

As is well known, writing instruments providing a single color or function are quite inconvenient under certain circumstances. For instance, designers or draftsman need several color pencils to prepare design drawings; students need pencils of different grades for writing answers and darkening circles in multiple choice questions during examinations, and so forth. Accordingly, in a further example as shown in FIG. 6, the writing tips 2 of the present invention may be designed to be pencil tips, color pencil tips, ball-point tips, correction fluid tips, crayon tips, etc. Obviously, the mounting wall 11 is preferably formed of transparent material to allow easy identification and selection. Besides, it is also apparent that writing tips 2 of various colors may be connected in a series.

Figure 7:
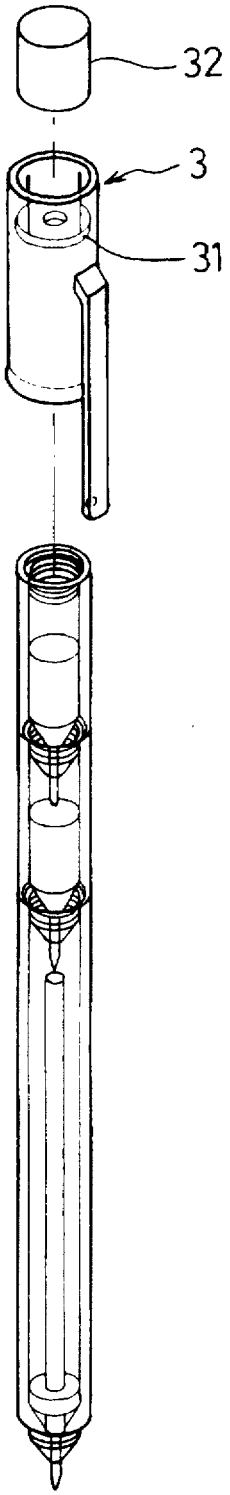
FIG. 7 is a schematic view illustrating the writing instrument of the present invention with a cap.

Furthermore, in order to facilitate carrying, as shown in FIG. 6 and 7, a cap 3 having a ferrule 31 and an eraser 32 may be provided.

Figure 8A:
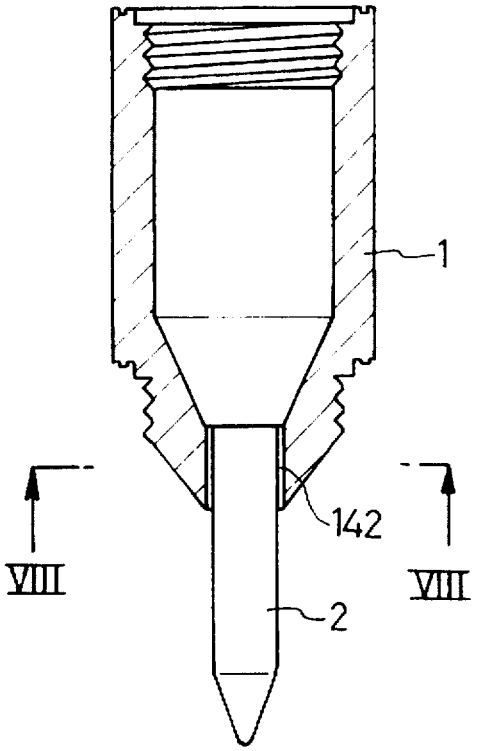
FIG. 8*a* is a longitudinal sectional view of the writing unit.
Figure 8B:
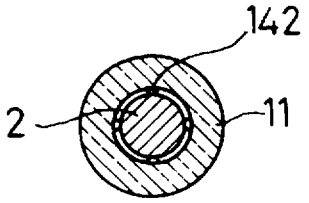
FIG. 8*b* is a cross-sectional view of FIG. 8*a*, taken along line VIII—VIII.

With reference to FIG. 8, in order to enhance the clamping effect by increasing the frictional force between the mounting 1 and the writing tip 2, the tip hole 14 is provided with a plurality of ribs 142 extending integrally from an inner wall thereof for clamping the writing tip 2 inserted thereinto. Additionally, the outer surface of the mounting wall 11 above the insert surface 15 is configured to have patterns or to be polygonal.

In summary, the writing instrument according to the present invention offers a number of writing tips to accommodate the needs of users, and the writing tips may be refilled or replaced, eliminating the drawbacks in the prior art.

Although the present invention has been illustrated and described with reference to the preferred embodiment thereof, it should be understood that it is in no way limited to the details of such embodiment but is capable of numerous modifications within the scope of the appended claims.

What is claimed is:

1. A multi-purpose writing instrument having a plurality of writing units removably attached together, wherein each writing unit comprises:

a) a substantially tubular mounting wall having an upper end forming a mounting step and an upper surface with a plurality of notches, the upper end having an internal thread, and a lower section having an insert surface configured to engage the mounting step of an adjacent writing unit, a plurality of lugs located so as to engage the plurality of notches of an adjacent writing unit, an external thread configured to engage the internal thread of an adjacent writing unit and a tapered lower end forming a tip hole;

b) a writing tip inserted into the tip hole so as to be connected to the tubular mounting wall; and, c) a plurality of stops extending from the mounting wall into the tip hole so as to bear against the writing tip to prevent displacement of the writing tip into the mounting wall.

2. The multi-purpose writing instrument as claimed in claim 1, further comprising a cap having a ferrule and an eraser.

3. The multi-purpose writing instrument as claimed in claim 1, wherein said mounting wall is made of transparent material.

4. The multi-purpose writing instrument as claimed in claim 1, wherein an outer surface of said mounting wall has a polygonal configuration.

5. The multi-purpose writing instrument as claimed in claim 1, further comprising a plurality of ribs extending into the tip hole for enhancing clamping of said writing instrument therein.

6. The multi-purpose writing instrument of claim 1 wherein the lower end of the mounting wall forms a plurality of elongated air passages in communication with the tip hole enabling ambient air to pass into the tubular mounting wall.

7. The multi-purpose writing instrument of claim 1 wherein at least one of said writing tips comprises a pencil.

8. The multi-purpose writing instrument of claim 1 wherein at least one of said writing tips comprises a pen.

9. The multi-purpose writing instrument of claim 1 wherein at least one of said writing tips comprises a make-up applicator.

10. The multi-purpose writing instrument of claim 1 wherein at least one of said writing tips comprises a touching pen for touching a liquid crystal display (LCD).

* * * * *